United States Patent [19]

Franklin

[11] Patent Number: 4,887,783

[45] Date of Patent: Dec. 19, 1989

[54] T-DIVIDER BRACKET ASSEMBLY

[75] Inventor: Robert P. Franklin, Lake Hopatcong, N.J.

[73] Assignee: Trans-World Marketing Corporation, East Rutherford, N.J.

[21] Appl. No.: 327,417

[22] Filed: Mar. 20, 1989

Related U.S. Application Data

[63] Continuation of Ser. No. 141,048, Jan. 5, 1988, abandoned.

[51] Int. Cl.[4] ..... A47F 7/00

[52] U.S. Cl. ..... 248/220.4; 248/225.1; 52/239; 211/88

[58] Field of Search ..... 248/220.4, 201, 225.1, 248/223.4; 40/605; 52/36, 239; 211/88

[56] References Cited

U.S. PATENT DOCUMENTS

| | | | |
|---|---|---|---|
| 3,362,093 | 1/1968 | Joselevich | 40/605 X |
| 3,489,290 | 1/1970 | Carson | 248/220.4 X |
| 3,886,698 | 6/1975 | Raith et al. | 52/36 |
| 4,102,095 | 7/1978 | Gartung | 52/239 X |
| 4,155,459 | 5/1979 | Marschak | 248/220.4 X |
| 4,581,868 | 4/1986 | McCann | 52/235 X |
| 4,632,256 | 12/1986 | Gambello | 248/220.4 X |

FOREIGN PATENT DOCUMENTS

| | | | |
|---|---|---|---|
| 1918464 | 12/1970 | Fed. Rep. of Germany | 52/239 |
| 2042122 | 2/1972 | Fed. Rep. of Germany | 248/223.4 |
| 2047519 | 12/1980 | United Kingdom | 248/223.4 |

*Primary Examiner*—Alvin C. Chin-Shue

*Attorney, Agent, or Firm*—Ostrolenk, Faber, Gerb & Soffen

[57] ABSTRACT

A pegboard display includes a pegboard rear wall having leftmost and rightmost edges, a plurality of openings being formed in the rear wall at spaced locations extending from the leftmost to the rightmost edges, a display divider, and a bracket assembly which cooperates with the pegboard openings to removably couple the display divider to the rear wall at substantially any position along the rear wall including the leftmost and rightmost edges of the rear wall. The bracket assembly includes a pegboard wall bracket having a divider bracket receiving portion and a plurality of fingers for releasably securing the wall bracket to the openings in the pegboard. The bracket assembly further includes a divider bracket having a first portion which is coupled to the display divider and a second portion adapted to be removably received in the divider bracket receiving portion of the wall bracket.

18 Claims, 3 Drawing Sheets

T-DIVIDER BRACKET ASSEMBLY

This is a continuation of application Ser. No. 141,048 filed on Jan. 5, 1988, now abandoned.

BACKGROUND OF THE INVENTION

The present invention is directed toward a T-divider bracket assembly, and more particularly to a T-divider bracket assembly for use in a pegboard wall system.

Pegboard wall systems such as shown in U.S. Pat. No. 4,428,136 have become increasingly popular over the past several years. Such systems generally include a generally planar pegboard rear wall and a plurality of dividers which extend orthogonally to the rear wall and which are utilized to divide the rear wall into separate bays in which merchandise of a particular type can be displayed. A plurality of hangers, usually adapted to support blister packs, are inserted into the holes in the pegboard at desired locations. The use of the dividers makes it possible to segregate related items from related items. For example, all the lipsticks of a single manufacturer may be maintained in a first bay while those of a second manufacturer may be maintained in an adjacent bay.

When utilizing such systems, it is highly desirable to have as much flexibility as possible. Different retail establishments will desire different sized bays depending upon the number and type of products being displayed. Indeed, a single retail establishment may wish to periodically change the size of its bay.

BRIEF DESCRIPTION OF THE INVENTION

It is a primary object of the present invention to provide a T-divider bracket assembly which may be used to support a T-divider for a pegboard type wall system, which bracket assembly is inexpensive, will support substantial weights, and which will enable the T-divider to be coupled to the pegboard rear wall at substantially any location along the rear wall.

In accordance with the foregoing, the divider bracket assembly of the present invention comprises:

a pegboard wall bracket having a divider bracket receiving portion and the means for releasably securing said wall bracket to openings in a pegboard;

a divider bracket having a first portion which may be coupled to a divider and a second portion adapted to be removably received in said divider bracket receiving portion of said wall bracket.

The present invention is also directed towards a pegboard display comprising:

a pegboard rear wall having leftmost and rightmost edges, a plurality of openings being formed in said rear wall at spaced locations extending from said leftmost to said rightmost edges;

a display divider;

bracket means for cooperating with said openings to removably couple said display divider to said rear wall at substantially any position along said rear wall including said leftmost and rightmost edges.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
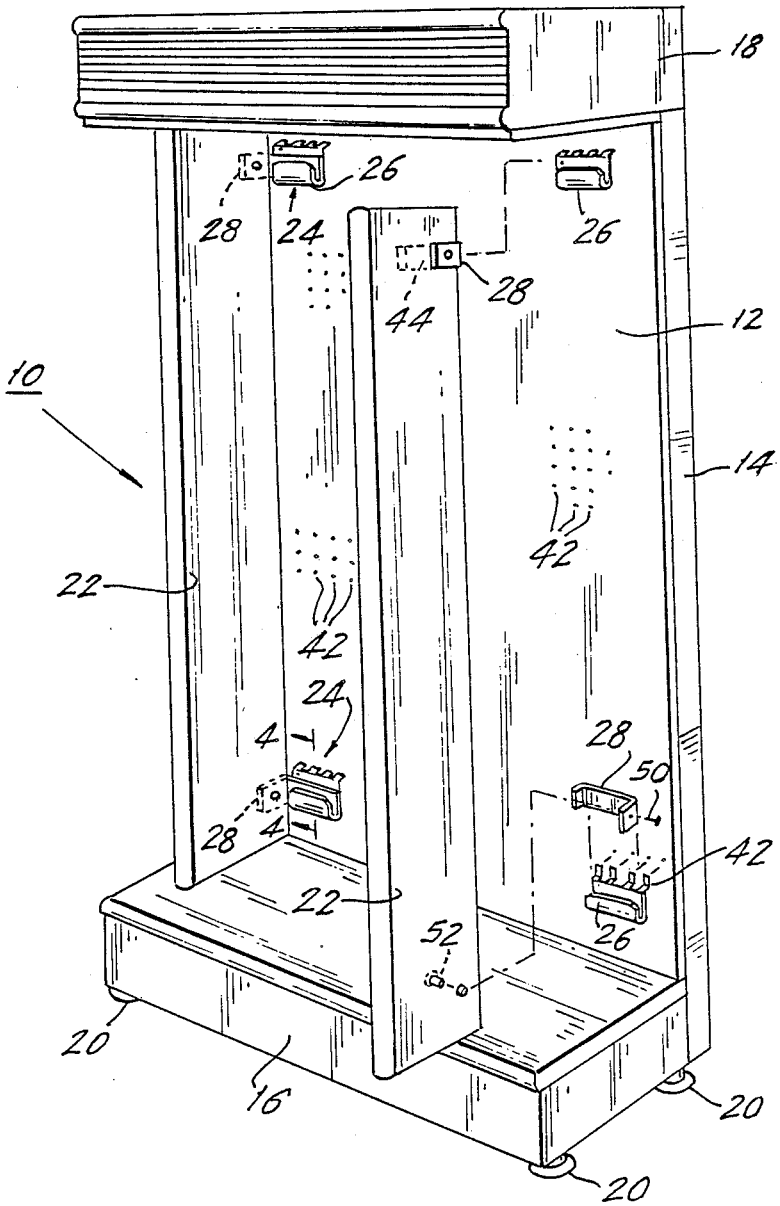
FIG. 1 is a perspective view of a display system module utilizing the T-divider bracket assembly of the present invention.

Referring now to the drawings wherein like numerals indicate like elements, there is shown in FIG. 1 a display system module which utilizes the T-divider bracket assembly of the present invention and which is designated generally as 10. The display system module 10 includes a pegboard rear wall 12 supported by a frame 14 which is coupled to a gondola base 16. The frame 14 also supports a header 18 which preferably contains advertising or informational material. The gondola base is supported by a plurality of adjustable legs 20 which may be screwed into and out of the gondola base 16 so as to insure that the gondola base, and with it the module 10, is level.

Figure 2:
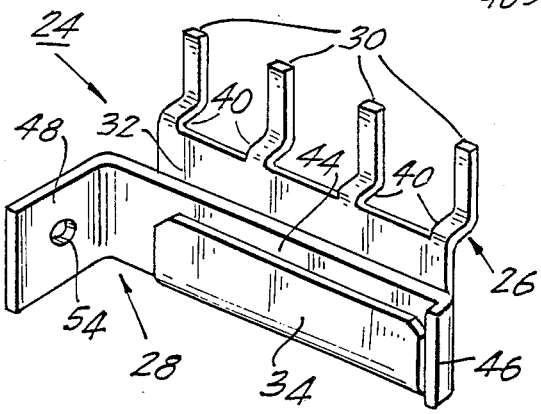
FIG. 2 is a perspective view of the two components forming the T-divider bracket assembly of the present invention.
Figure 3:
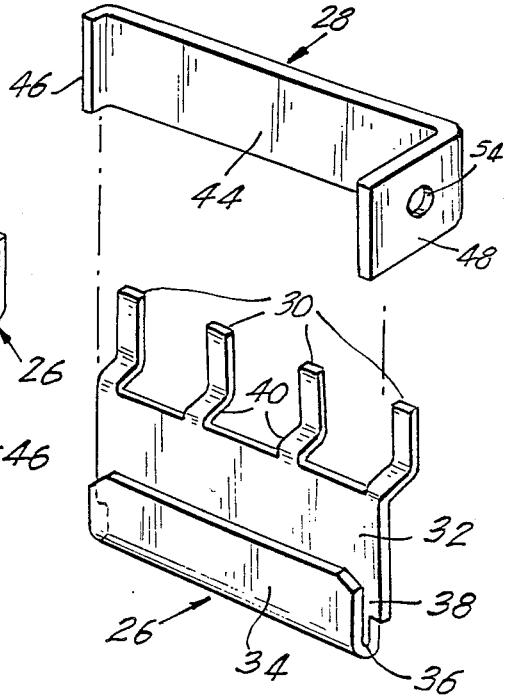
FIG. 3 is an exploded perspective view of the T-divider bracket assembly of the present invention.

In FIG. 1, a single module 10 is illustrated. A plurality of modules may be placed side-by-side so as to form a display system appearing to have a continuous rear wall, a continuous gondola base and a continuous header. In a typical application, three to five modules 10 are coupled together to form a single display system which is preferably divided into a plurality of bays by T-dividers 22. Any given module 10 may be divided into a plurality of bays if desired. As best illustrated in FIGS. 2 and 3, bracket assembly 24 includes a pegboard wall bracket 26 and the T-divider bracket 28. The wall bracket 28 includes a plurality of fingers 30 which are adapted to extend through respective pegboard openings 42 in rear wall 12 so as to firmly support the wall bracket 26 at any desired location along the rear wall 12.

Figure 4:
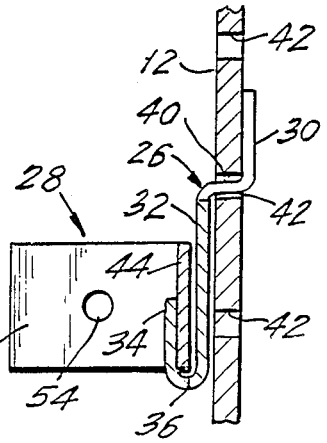
FIG. 4 is a partial cross sectional view of showing the manner in which the T-divider bracket assembly of the present invention is connected to a pegboard rear wall and taken along lines 4—4 of FIG. 1.

As best shown in FIGS. 3 and 4, wall bracket 26 includes the planar support surface 32 which is spaced from and parallel to a front support surface 34 and connected thereto by transverse, semicircular extension 36 to form a U-shaped bracket receiving channel 38. As will be described in further detail below, the bracket receiving channel 38 is adapted to receive the bracket insertion leg 44 of the T-divider bracket 28 in the manner illustrated in FIGS. 5 and 6.

The fingers 30 are connected to support surface 32 by respective spacer legs 40 having a length which is slightly greater than the thickness of the pegboard rear wall 12. The planar support surface 32 and the fingers 30 lie in parallel planes spaced from one another by a distance slightly greater than the thickness of pegboard rear wall 12 so that the wall bracket 26 may be firmly coupled to the pegboard rear wall 12 by placing the four fingers 30 through respective openings 42 in the pegboard rear wall 12.

The T-divider bracket 28 (FIGS. 2 and 3) includes an elongated planar bracket insertion leg 44 adapted to be received within bracket receiving channel 38, a stop 46 formed on one end of insertion leg 44 and a divider connector 48 formed on the remaining end of insertion leg 44. Connector 48 is coupled to T-divider 22 by a bolt 50 and nut 52 which extend through openings 54 and 56 in divider connector 48 and T-divider 22, respectively.

Figure 5:
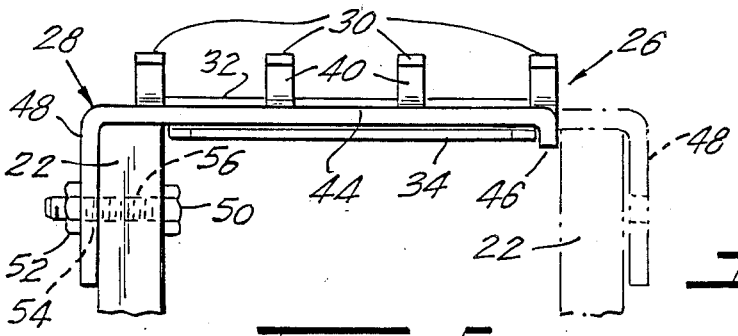
FIG. 5 is a top view illustrating the manner in which the T-divider bracket assembly can support a T-divider in either a left-hand or a right-hand orientation.
Figure 6:
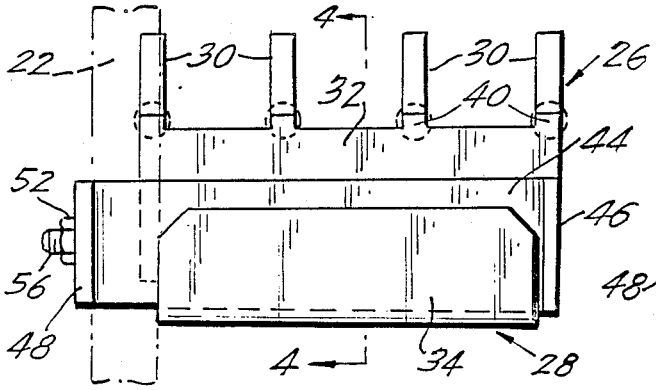
FIG. 6 is a front view illustrating the manner in which the T-divider bracket assembly of the present invention can support a T-divider bracket assembly in a left-hand mode.

The length of insertion leg 44 is slightly greater than the combined length of front support surface 34 and the width of T-divider 22 so that the bracket insertion leg 44 may be inserted into the bracket receiving channel 38 of wall bracket 26 with a slight amount of play. As best shown in FIG. 5, the bracket insertion leg 44 can be inserted into the bracket receiving channel 38 with the T-divider 22 being located on either the left side of wall bracket 26 as shown in solid lines, or on the right side of wall bracket 26 as shown in phantom.

Figure 7:
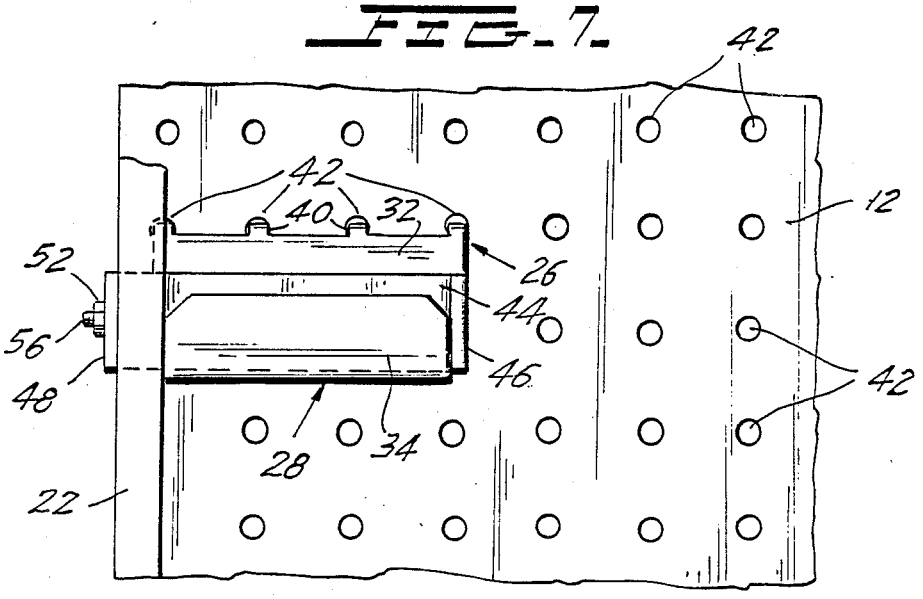
FIG. 7 is a partial detail view showing the manner in which the T-divider bracket assembly of the present invention can be used to place the T-divider at the extreme left-hand side of a pegboard rear wall.
Figure 8:
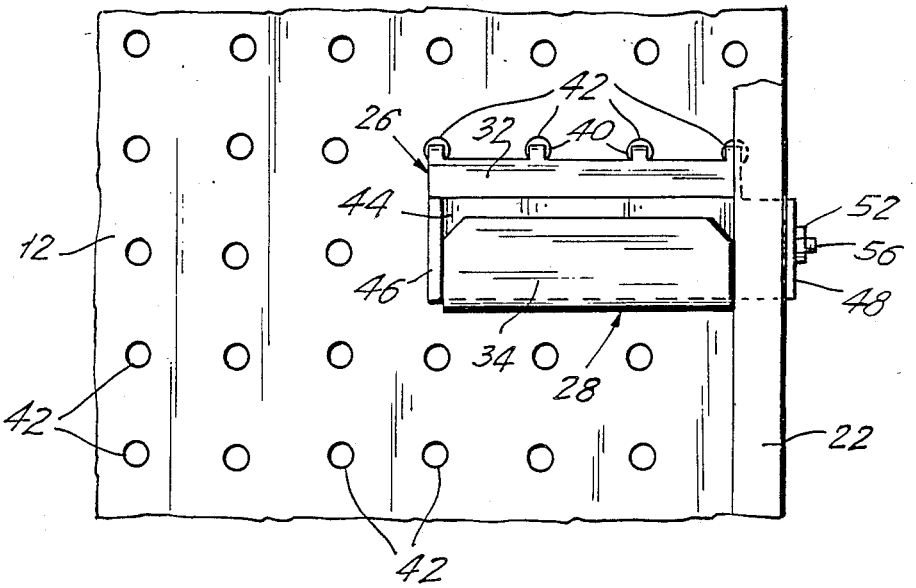
FIG. 8 is a partial detail view illustrating the manner in which the T-divider bracket assembly of the present invention may be utilized to place the T-divider at the rightmost edge of a pegboard rear wall.

As best shown in FIG. 1, each T-divider 22 is coupled to rear wall 12 by a pair of bracket assemblies 24. The upper and lower T-divider brackets 28 are preferably connected an equal distance from the respective top and bottom edges of the T-divider 22, so as to allow the T-divider 22 to be mounted on either the left or right hand edges of the wall brackets 26. As a result of the foregoing structure, the bracket assembly 24 of the present invention makes it possible to locate the T-dividers 22 at substantially any location along the pegboard rear wall 12, including the leftmost (FIG. 7) and rightmost (FIG. 8) edges of the display system module 10. This provides extreme flexibility with the present invention, while at the same time providing a very inexpensive bracket structure which will firmly and securely support the T-divider 22 to the rear wall 12.

Although the present invention has been described in connection with a preferred embodiment thereof, many variations will now become apparent to those skilled in the art. It is preferred, therefore, that the present invention be limited not by the specific disclosure herein, but only by the appended claims.

What is claimed is:

1. A bracket assembly coupling a bay divider wall to a generally planar peg board wall, said bracket assembly comprising:

(A) a peg board wall bracket including:

(1) an elongated U-shaped channel having a closed bottom and an open top; and (2) peg means coupling said wall bracket to apertures in said peg board wall such that said U-shaped channel extends horizontally and parallel to said peg board wall and said open top faces upwardly; and (B) means supporting said bay divider, said bay divider supporting means comprising a single piece right angled divider wall bracket having first and second arms extending at right angles to one another, one of said arms being secured to the bay divider wall, the remaining of said arms being inserted into said open top of said wall bracket and held within said U-shaped channel by the force of gravity and extending horizontally on its side therein.

2. The bracket assembly of claim 1, wherein said second arm is receivable within said U-shaped channel in a first orientation wherein said first arm extends from one side of said U-shaped channel and a second orientation wherein said first arm extends from another side of said U-shaped channel.

3. The bracket assembly of claim 1, wherein said means for coupling said wall bracket to a pegboard comprises a plurality of spaced fingers for insertion into the openings in a pegboard.

4. The bracket assembly of claim 1, wherein said U-shaped channel is defined by two generally planar walls which are spaced from and parallel to one another and which are coupled to each other via a transverse connecting wall, and wherein said coupling means are so constructed that when said wall bracket is secured to said planar pegboard wall by means of said coupling means said planar walls lie substantially parallel to said peg board wall.

5. The bracket assembly of claim 4, wherein said means for coupling said wall bracket to a pegboard comprises a plurality of fingers extending from said divider bracket receiving portions for extending into openings in said pegboard.

6. The bracket assembly of claim 5, wherein said fingers lie in a plane parallel to and spaced from said planar walls.

7. The bracket assembly of claim 6, wherein said U-shaped channel has an open left end and an open right end and wherein said second arm is generally planar and is removably receivable within said U-shaped channel and wherein said first arm of said divider bracket is generally planar and extends at right angles to the plane of said second arm.

8. The bracket assembly of claim 7, wherein the length of said second arm is greater than the length of said U-shaped channel.

9. The bracket assembly of claim 8, wherein said first arm extends from a first end of said second arm and wherein a stop is located on a second, opposite, end of said second arm.

10. A peg board display, comprising:

(A) a peg board rear wall having left most and right most edges, a plurality of openings being formed in said rear wall at space locations extending from said left most to said right most edges;

(B) a peg board wall bracket including:

(1) an elongated U-shaped channel having a closed bottom and an open top; and (2) peg means coupling said wall bracket to apertures in said peg board wall such that said U-shaped channel extends horizontally and parallel to said peg board wall and said open top faces inwardly; and (C) means supporting a bay divider, said bay divider wall supporting means comprising a single piece right angled divider bracket having first and second arms extending at right angles to one another, one of said arms being secured to the bay divider wall, the remaining of said arms being to be inserted into said open top of said wall bracket and held within said U-shaped channel by the force of gravity and extending horizontally on its therein.

11. The pegboard display of claim 10, wherein said divider bracket may be received within said U-shaped channel in a first orientation wherein said divider is located on a first side of said wall bracket and a second orientation wherein said divider is located on a second, opposite side of said wall bracket.

12. The pegboard display of claim 11, wherein said second arm is longer than said first arm.

13. The pegboard display of claim 12, wherein said peg means comprises a plurality of spaced fingers adapted to be inserted into respective said apertures in said pegboard.

14. The pegboard display of claim 13, wherein said U-shaped channel is defined by two generally planar walls which are spaced from and parallel to one another and which are coupled to each other via a transverse connecting wall, and wherein said coupling means are so constructed that when said wall bracket is secured to said planar pegboard wall by means of said coupling means said planar walls lie substantially parallel to said pegboard rear wall.

15. The pegboard display of claim 14, wherein said fingers lie in a plane parallel to and spaced from said planar walls.

16. The pegboard display of claim 15, wherein said U-shaped channel has an open left end and an open right end and wherein said second arm of said divider bracket is generally planar and is removably receivable within said U-shaped channel and wherein said first arm of said divider bracket is generally planar and extends at right angles to the plane of said second arm.

17. The pegboard display of claim 16, wherein said second arm is longer than said U-shaped channel.

18. The pegboard display of claim 17, wherein said first arm extends from a first end of said second arm and wherein a stop is located on a second, opposite, end of said second arm.

* * * * *